US011387605B2

(12) United States Patent
Zeng et al.

(10) Patent No.: US 11,387,605 B2
(45) Date of Patent: Jul. 12, 2022

(54) CONDUCTIVE SHEET STRUCTURE AND HIGH-SPEED CONNECTOR

(71) Applicant: DONGGUAN LUXSHARE TECHNOLOGIES CO., LTD, Dongguan (CN)

(72) Inventors: Chenhui Zeng, Dongguan (CN); Yunfeng He, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/091,641

(22) Filed: Nov. 6, 2020

(65) Prior Publication Data

US 2021/0384678 A1 Dec. 9, 2021

(30) Foreign Application Priority Data

Jun. 5, 2020 (CN) ..... 202010505716.2

(51) Int. Cl.
*H01R 13/646* (2011.01)
*H01R 12/71* (2011.01)
(Continued)

(52) U.S. Cl.
CPC ..... *H01R 13/646* (2013.01); *H01R 12/71* (2013.01); *H01R 12/716* (2013.01); *H01R 13/50* (2013.01); *H01R 13/6471* (2013.01)

(58) Field of Classification Search
CPC .. H01R 13/646; H01R 13/6471; H01R 13/50; H01R 12/71; H01R 12/716; H01R 31/08;
(Continued)

(56) References Cited

U.S. PATENT DOCUMENTS 5,664,968 A * 9/1997 Mickievicz ..... H01R 13/6582 439/607.1
8,105,114 B2 * 1/2012 Kagotani ..... H01R 12/716 439/639
(Continued)

FOREIGN PATENT DOCUMENTS

CN 107611717 A 1/2018
CN 108448282 A 8/2018
(Continued)

OTHER PUBLICATIONS

Chinese Office Action and Search Report for Chinese Application No. 202010505716.2, dated Feb. 1, 2021, with English translation.

*Primary Examiner* — Travis S Chambers
(74) *Attorney, Agent, or Firm* — Birch, Stewart, Kolasch & Birch, LLP

(57) ABSTRACT

Provided are a conductive sheet structure and a high-speed connector. The conductive sheet includes a conductive sheet, and a plurality of elastic arms are disposed on the conductive sheet with spacings. Each elastic arm includes a connecting section, a tilt section and a contact section which are connected in sequence. The connecting section is fixedly connected to the conductive sheet. The tilt section is tilted relative to the conductive sheet and the tilt angle between the tilt section and the conductive sheet is variable. The contact section is used for contacting with a grounding terminal on a high-speed connector.

20 Claims, 6 Drawing Sheets

(51) Int. Cl.
*H01R 13/50* (2006.01)
*H01R 13/6471* (2011.01)

(58) Field of Classification Search
CPC .. H01R 13/6597; H01R 13/02; H01R 13/193; H01R 13/5025; H01R 13/652
USPC ..... 439/386
See application file for complete search history.

(56) References Cited

U.S. PATENT DOCUMENTS

| | | | | |
|---|---|---|---|---|
| 8,944,849 | B1 * | 2/2015 | Yang | H01R 13/6588 439/607.07 |
| 9,496,657 | B1 * | 11/2016 | Chang | H01R 13/6597 |
| 9,673,569 | B2 * | 6/2017 | Zhang | H01R 13/6585 |
| 10,027,066 | B2 * | 7/2018 | Zhong | H01R 13/6597 |
| 10,461,475 | B2 * | 10/2019 | Little | H01R 13/6587 |
| 10,756,489 | B2 * | 8/2020 | Hu | H01R 12/737 |
| 11,050,176 | B2 * | 6/2021 | Yang | H01R 12/62 |
| 2016/0006182 | A1 | 1/2016 | Patel | |
| 2018/0013240 | A1 | 1/2018 | Takeuchi | |
| 2020/0212636 | A1 * | 7/2020 | Chang | H01R 13/6474 |

FOREIGN PATENT DOCUMENTS

| | | | |
|---|---|---|---|
| CN | 108448292 | A | 8/2018 |
| CN | 108832338 | A | 11/2018 |
| CN | 109273932 | A | 1/2019 |
| CN | 109713489 | A | 5/2019 |
| CN | 109742606 | A | 5/2019 |
| TW | M500382 | U | 5/2015 |
| TW | M583144 | U | 9/2019 |
| TW | M595913 | U | 5/2020 |

* cited by examiner

CONDUCTIVE SHEET STRUCTURE AND HIGH-SPEED CONNECTOR

CROSS-REFERENCE TO RELATED APPLICATION

This application claims priority to Chinese Patent Application No. 202010505716.2 filed Jun. 5, 2020, the disclosure of which is incorporated herein by reference in its entirety.

TECHNICAL FIELD

The present disclosure relates to the technical field of communication device and, in particular, to a conductive sheet structure and a high-speed connector.

BACKGROUND

A high-speed connector is a key component of a communication device. The stability of the high-speed connector directly affects the signal transmission of the communication device.

In the related art, a high-speed connector typically includes a plastic housing, a plurality of terminals fixed to the plastic housing, and conductive sheets in contact with the terminals. Specifically, the terminals include a plurality of ground pin terminals and two signal terminals which are disposed between each two adjacent ground pin terminals with spacings, the conductive sheet is of an integral structure, the conductive sheet is provided with a plurality of lower concave surfaces corresponding to the ground pin terminals, and each lower concave surface is in contact with the corresponding ground pin terminal. That is, in the related art, the mode of contact between the conductive sheet and the ground pin terminals is integral surface contact or single-point contact. Such contact mode has a high requirement on the planeness of the ground pin terminals as well as the stamping height of the ground pin terminals. Thus, the ground pin terminals are prone to ineffective contact with the conductive sheet. That is, the high-speed connector in the related art is prone to poor contact, thereby affecting the signal integrity (SI) performance of the high-speed connector and further affecting the signal transmission of a communication device.

SUMMARY

The present disclosure provides a conductive sheet structure and a high-speed connector, in which the conductive sheet can be in effective contact with a grounding terminal, so that the probability of poor contact of the high-speed connector is reduced, and signal transmission of a communication device is guaranteed.

The conductive sheet structure includes a conductive sheet, and a plurality of elastic arms disposed on the conductive sheet with spacings. Each elastic arm includes a connecting section, a tilt section and a contact section which are connected in sequence. The connecting section is fixedly connected to the conductive sheet. The tilt section is tilted relative to the conductive sheet and the tilt angle between the tilt section and the conductive sheet is variable. The contact section is used for contacting with a grounding terminal on a high-speed connector.

Optionally, the conductive sheet is provided with a plurality of openings, and at least one elastic arm is fixed in each opening.

Optionally, each opening is a rectangle opening, two elastic arms are arranged in each opening, the two elastic arms are respectively fixed to two opposite inner walls of a respective opening, and the two elastic arms can be in contact with a same grounding terminal.

Optionally, the two elastic arms are staggered, or the two elastic arms are symmetrically arranged.

Optionally, the openings are arranged in an array on the conductive sheet.

Optionally, the elastic arms include a plurality of first elastic arms and a plurality of second elastic arms. The first elastic arms are arranged on the edge of one side of the conductive sheet with spacings, the second elastic arms are arranged on the edge of another side of the conductive sheet with spacings, and each second elastic arm corresponds to a respective first elastic arm and is connectable to the same grounding terminal as the respective first elastic arm.

Optionally, a surface, which is contacted with the grounding terminal, of the contact section is flat.

The present disclosure provides a high-speed connector, which includes a housing; a plurality of grounding terminals and a plurality of signal terminals, both of which are fixed to the housing; and the preceding conductive sheet structure, where the conductive sheet structure is fixed to the housing, and each contact section abuts against one grounding terminal.

Optionally, the high-speed connector includes one or more conductive sheet structures, and when the high-speed connector includes a plurality of conductive sheet structures, a part of the conductive sheet structures is fixed to an upper wall of the housing, and the other part of the conductive sheet structures is fixed to a side wall of the housing.

Optionally, at least one of the upper wall or the side wall of the housing is provided with a fixing groove in which the conductive sheet structure is welded or glued.

REFERENCE LIST

Figure 1:
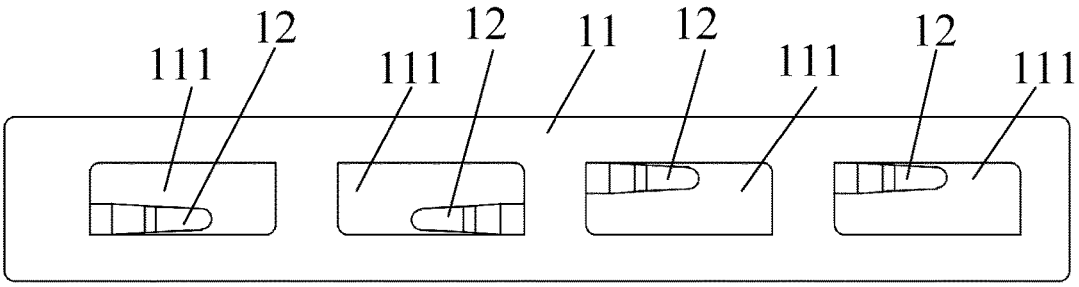
FIG. 1 is a schematic view of a conductive sheet structure according to embodiments of the present disclosure.
Figure 2:
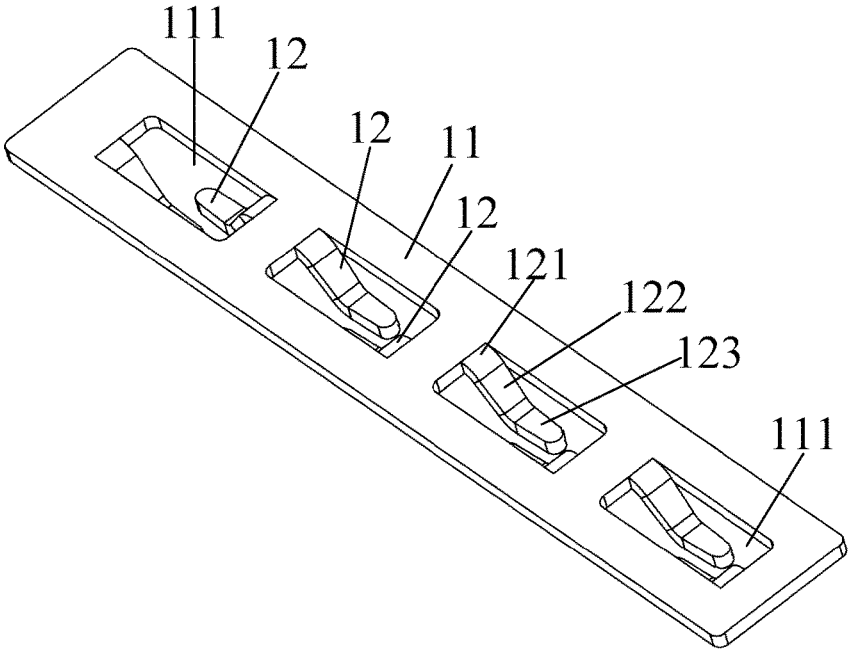
FIG. 2 is a schematic view of another conductive sheet structure according to embodiments of the present disclosure.

1 conductive sheet structure
11 conductive sheet
111 opening
12 elastic arm
121 connecting section
122 tilt section
123 contact section
124 first elastic arm
125 second elastic arm
2 housing
21 upper wall
22 side wall
23 fixing groove
3 grounding terminal
4 signal terminal

DETAILED DESCRIPTION

The solution of the present disclosure is further described in conjunction with drawings and embodiments. It is to be understood that the embodiments described herein are intended to illustrate and not to limit the present disclosure.

In the description of the present disclosure, it is to be noted that orientations or position relations indicated by terms such as "center", "upper", "lower", "left", "right", "vertical", "horizontal", "in", "out" are orientations or position relations based on the drawings. These orientations or position relations are intended only to facilitate the description of the present disclosure and simplify the description and not to indicate or imply that a device or element referred to must have such specific orientations or must be configured or operated in such specific orientations. Thus, these orientations or position relations are not to be construed as limiting the present disclosure. In addition, terms such as "first" and "second" are used only for the purpose of description and are not to be construed as indicating or implying relative importance.

In the description of the present disclosure, it is to be noted that terms "mounted", "joined" and "connected" are to be understood in a broad sense unless otherwise expressly specified and limited. For example, the term "connected" may refer to "fixedly connected" or "detachably connected", may refer to "mechanically connected" or "electrically connected" or may refer to "connected directly", "connected indirectly through an intermediary" or "connected in two components". For those of ordinary skill in the art, specific meanings of the preceding terms in the present disclosure may be understood based on specific situations.

An embodiment provides a conductive sheet structure 1 which can be in elastic contact with a grounding terminal 3 and thus can reduce the probability of poor contact of a high-speed connector.

As shown in FIGS. 1 to 8, the conductive sheet structure 1 includes a conductive sheet 11 and a plurality of elastic arms 12 disposed on the conductive sheet 11.

The elastic arms 12 are arranged on the conductive sheet 11 with spacings. Each elastic arm 12 includes a connecting section 121, a tilt section 122 and a contact section 123 which are connected in sequence. The connecting section 121 is fixedly connected to the conductive sheet 11. The tilt section 122 is tilted relative to the conductive sheet 11. The tilt angle between the tilt section 122 and the conductive sheet 11 is variable. That is, the distance from the end of the tilt section 122 closer to the contact section 123 to the conductive sheet 11 can be varied. The contact section 123 is used for contacting with a grounding terminal 3 on a high-speed connector.

When the contact section 123 is in contact with the grounding terminal 3, the elastic arm 12 is in a state of compression, that is, the distance between the end of the tilt section 122 closer to the contact section 123 and the conductive sheet 11 is smaller than the original distance (that is, the distance between the end of the tilt section 122 closer to the contact section 123 and the conductive sheet 11 when the contact section 123 is not in contact with the grounding terminal 3). In this manner, when the grounding terminal 3 has a different height, only the extent to which the elastic arm 12 is compressed is affected, and the contact section 123 is still able to be in contact with the grounding terminal 3.

According to the conductive sheet structure 1 provided by this embodiment, the elastic arms 12 are arranged on the conductive sheet 11, and the elastic arms 12 can be elastically deformed. In this manner, the conductive sheet 11 can be in elastic contact with the grounding terminal 3 through each elastic arm 12, so even if the top surface of the grounding terminal 3 is uneven, the contact section 123 of each elastic arm 12 can be in effective contact with the grounding terminal 3 due to the existence of the tilt section 122. Thus, the probability of poor contact of the high-speed connector is reduced, and signal transmission of communication device is guaranteed.

Optionally, the conductive sheet 11 may have various structures, and this embodiment provides two types of conductive sheets 11 as described below.

In the structure of one type of conductive sheet 11, as shown in FIGS. 1 to 7, the conductive sheet 11 is provided with a plurality of openings 111, and at least one elastic arm 12 is fixed in each opening 111. In the drawings, FIG. 1 is a schematic view showing one elastic arm 12 disposed in each opening 111, and FIGS. 2 to 7 are schematic views showing two elastic arms 12 disposed in each opening 111. Optionally, as shown in FIG. 1, when one elastic arm 12 is disposed in each opening 111, the elastic arm 12 may be located on any edge of each opening 111, or the orientations of the elastic arms 12 disposed on the conductive sheet 11 may be the same or different. When two or more elastic arms 12 are disposed in each opening 111, two or more elastic arms 12 located in the same opening 111 can be in contact with the same grounding terminal 3, ensuring that the grounding terminal 3 can be in effective contact with the conductive sheet 11.

Further, each opening 111 in the conductive sheet 11 may be a rectangle opening, and when two elastic arms 12 are disposed in each opening 111, as shown in FIGS. 2 to 7, each of the two elastic arms 12 may be fixed to a respective one of the opposite inner walls of each opening 111, and the two elastic arms 12 can be in contact with the same grounding terminal 3. When two elastic arms 12 are disposed in each opening 111, it is possible to make the conductive sheet structure 1 lighter and facilitate the mounting of the conductive sheet structure 1 while ensuring that the conductive sheet 11 is in effective contact with the grounding terminal 3.

Figure 3:
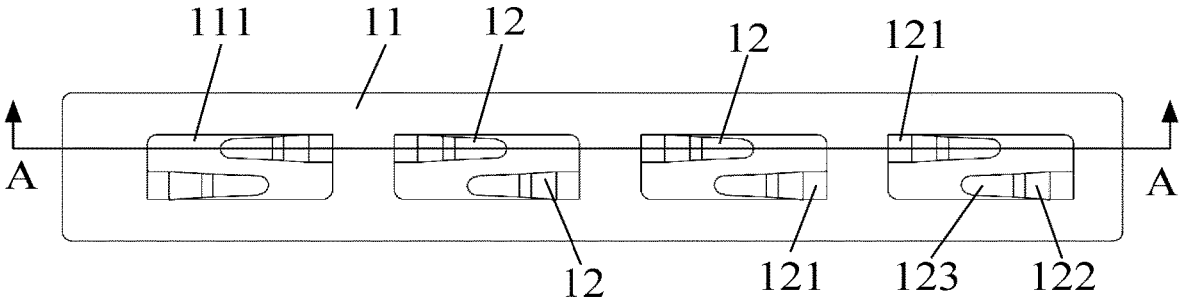
FIG. 3 is a top view of another conductive sheet structure according to embodiments of the present disclosure.
Figure 4:
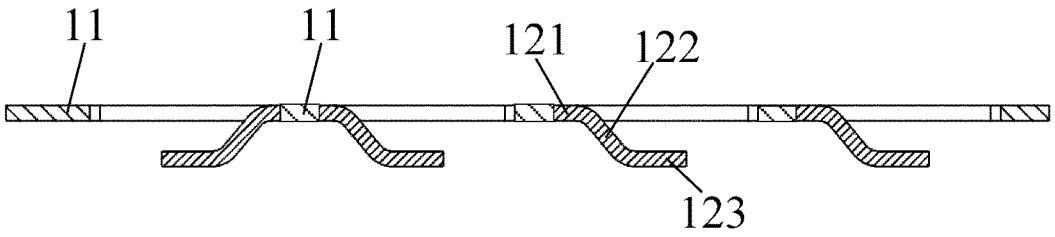
FIG. 4 is a section view taken along line A-A of the conductive sheet structure of FIG. 3 according to embodiments of the present disclosure.
Figure 5:
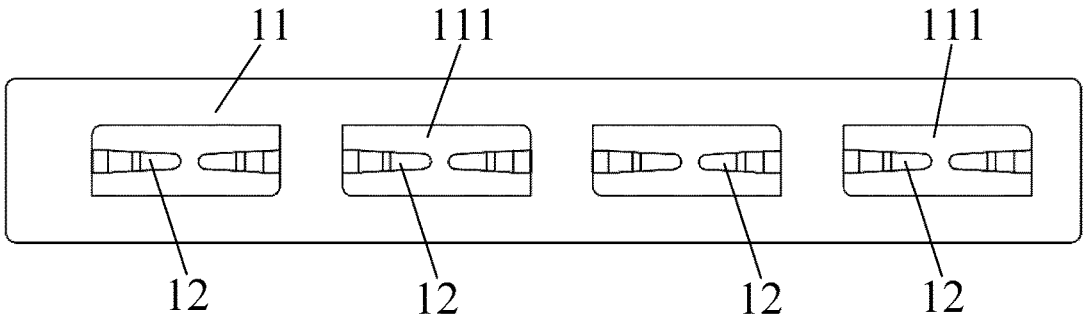
FIG. 5 is a schematic view of another conductive sheet structure according to embodiments of the present disclosure.
Figure 6:
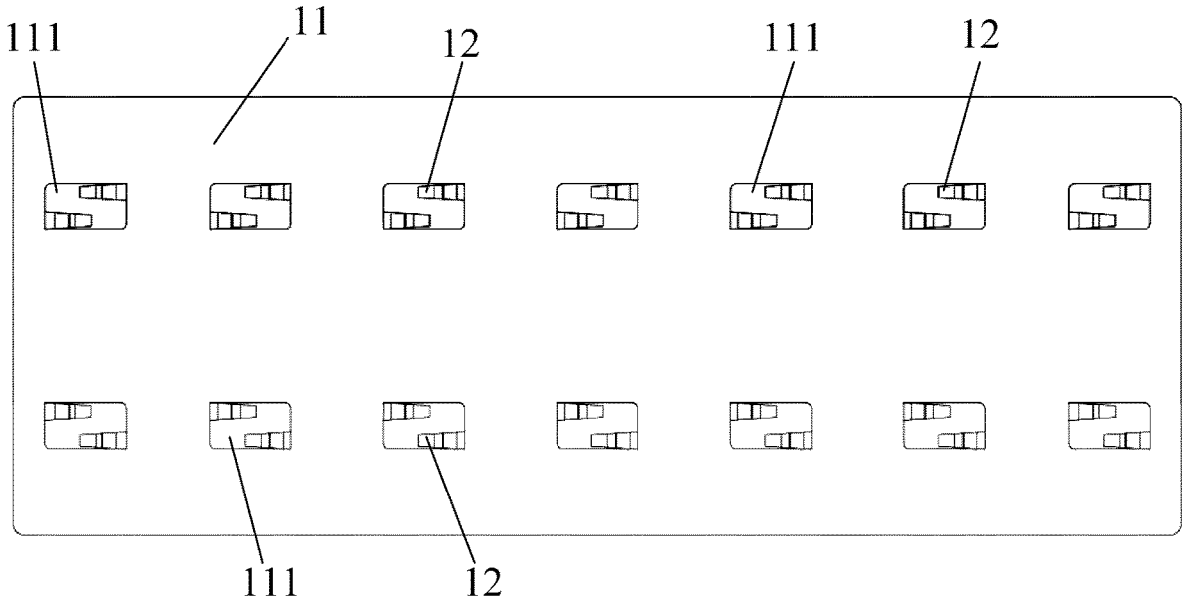
FIG. 6 is a schematic view of another conductive sheet structure according to embodiments of the present disclosure.
Figure 7:
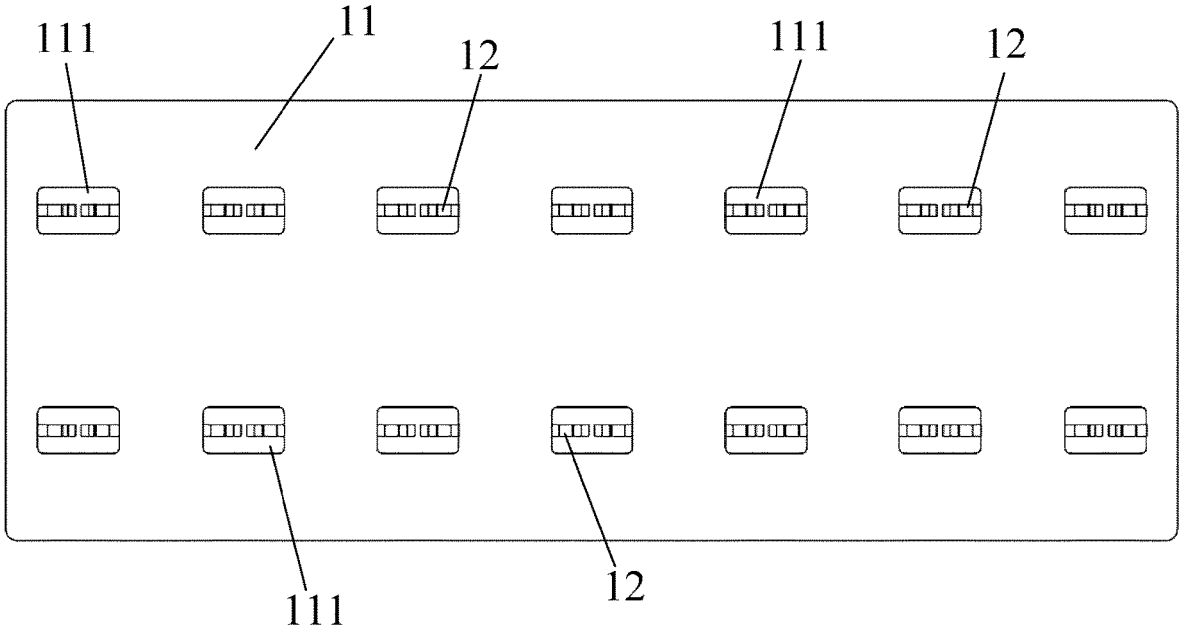
FIG. 7 is a schematic view of another conductive sheet structure according to embodiments of the present disclosure.

Optionally, when two elastic arms 12 are disposed in each opening 111, as shown in FIGS. 3, 4 and 6, two elastic arms 12 located in the same opening 111 may be staggered, or as shown in FIG. 5 or FIG. 7, two elastic arms 12 located in the same opening 111 may be symmetrically arranged. When two elastic arms 12 are staggered in one opening 111, as shown in the first opening 111 from the left of FIG. 3, the elastic arm 12 fixed to the left inner wall of the opening 111 may be located below the elastic arm 12 fixed to the right inner wall of the opening 111, or as shown in the second opening 111 from the left of FIG. 3, the elastic arm 12 fixed to the left inner wall of the opening 111 may be located above the elastic arm 12 fixed to the right inner wall of the opening 111, which is not limited in this embodiment.

Optionally, the openings 111 are arranged in an array on the conductive sheet 11. For example, the openings 111 may be arranged in a plurality of rows and columns on the conductive sheet 11 to apply to high-speed connectors having different structures. Exemplarily, as shown in FIG. 3 or FIG. 5, a plurality of openings 111 are arranged in sequence along the length direction of the conductive sheet 11. In this case, it can be considered that the openings 111 are arranged in one row and a plurality of columns, and each opening 111 can correspond to one grounding terminal 3. For example, the openings 111 may be in one row and four columns. As another example, as shown in FIGS. 6 and 7, the openings 111 are arranged in two rows and a plurality of columns on the conductive sheet 11, and the openings 111 located in the same column can correspond to the same grounding terminal 3. That is, the elastic arms 12 located in the openings 111 in the same column can be in contact with the same grounding terminal 3. For example, the openings 111 may be in two rows and seven columns. Such arrangement mode can be used for high-speed connectors having long grounding terminals.

Figure 8:
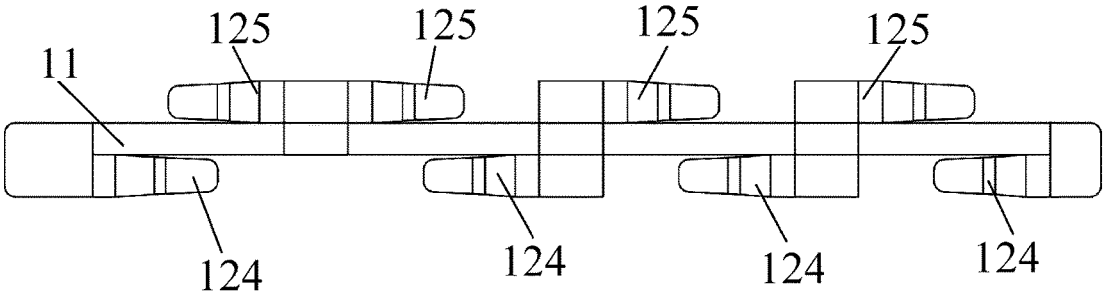
FIG. 8 is a schematic view of another conductive sheet structure according to embodiments of the present disclosure.

In the structure of another type of the conductive sheet 11, as shown in FIG. 8, the conductive sheet 11 is strip-shaped, the conductive sheet 11 is not provided with openings, and the elastic arms 12 include a plurality of first elastic arms 124 and a plurality of second elastic arms 125. The first elastic arms 124 are arranged on the edge of one side of the conductive sheet 11 with spacings, the second elastic arms 125 are arranged on the edge of the other side of the conductive sheet 11 with spacings, and each second elastic arm 125 corresponds to a respective first elastic arm 124 and is connectable to the same grounding terminal 3 as the respective first elastic arm 124. Exemplarily, the first elastic arms 124 and the second elastic arms 125 may be staggered on two sides of the conductive sheet 11, and the orientations of a first elastic arm 124 and a second elastic arm 125 corresponding to each other are opposite.

A conductive sheet structure 1 having either of the preceding two structures can be in stable and effective contact with the grounding terminal 3. Such conductive sheet structure 1 is simple in structure, convenient to manufacture and low in cost.

Optionally, as shown in FIG. 4, the surface, which is contacted with the grounding terminal 3, of the contact section 123 of the elastic arm 12 is flat so that the area, which is contacted with the grounding terminal 3, of the elastic arm 12 can be relatively large, further ensuring effective contact between the elastic arm 12 and the grounding terminal 3. Exemplarily, as shown in FIG. 4, the contact section 123 of the elastic arm 12 is sheet-shaped and parallel to the conductive sheet 11.

Figure 9:
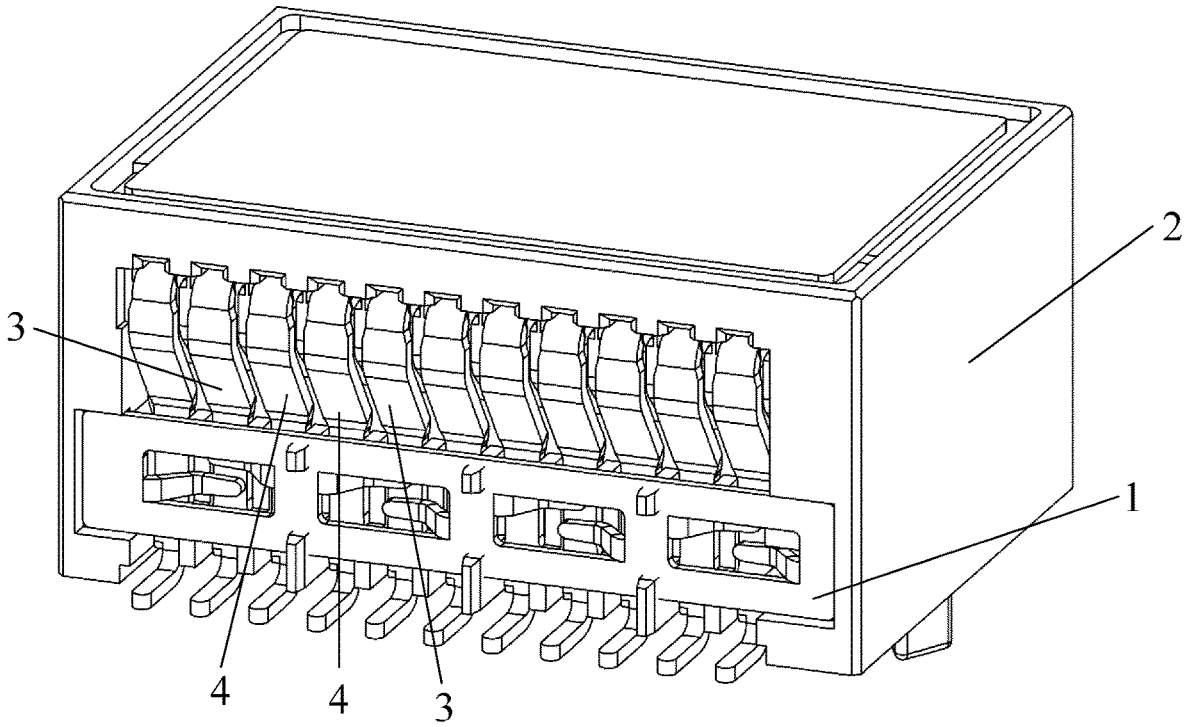
FIG. 9 is a schematic view illustrating the structure of a high-speed connector according to embodiments of the present disclosure.
Figure 10:
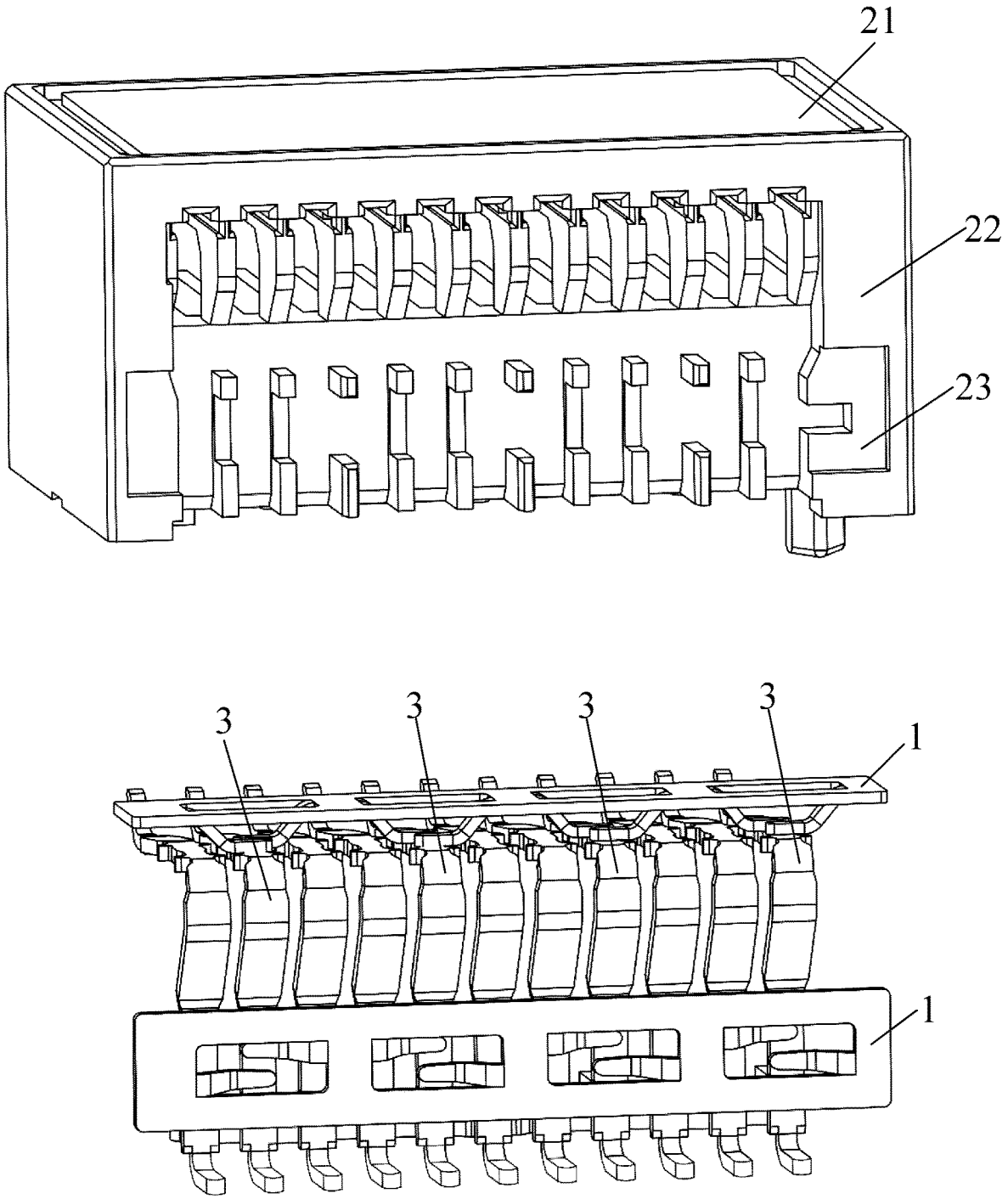
FIG. 10 is an exploded view of the high-speed connector according to embodiments of the present disclosure.
Figure 11:
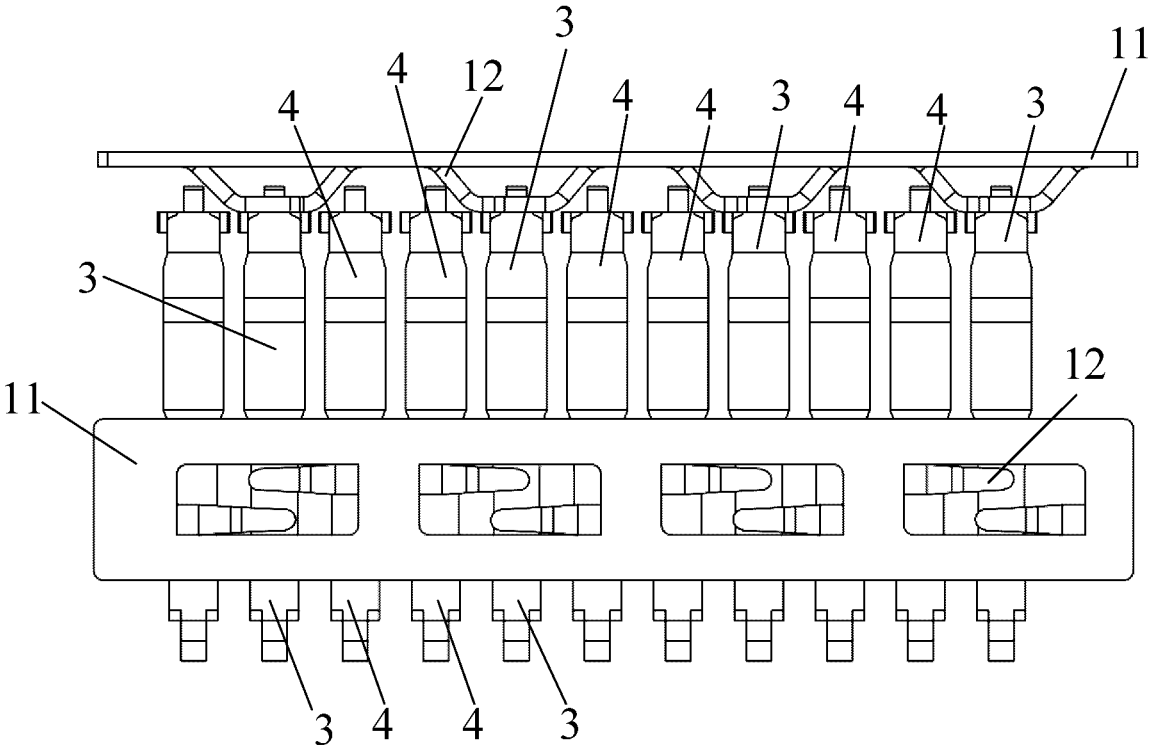
FIG. 11 is a schematic view illustrating the structure of a part of the high-speed connector according to embodiments of the present disclosure.

Another embodiment provides a high-speed connector. As shown in FIGS. 9 to 11, the high-speed connector includes a housing 2, a grounding terminal 3 and a signal terminal 4 fixed to the housing 2, and the preceding conductive sheet structure 1. The conductive sheet structure 1 is fixed to the housing 2. The contact section 123 in the elastic arm 12 abuts against the grounding terminal 3. Grounding terminals 3 and signal terminals 4 are arranged in sequence with spacings, and two signal terminals 4 are arranged between each two adjacent grounding terminals 3.

Further, the high-speed connector may include one or more conductive sheet structures 1, and when the high-speed connector includes a plurality of conductive sheet structures 1, a part of the conductive sheet structures 1 is fixed to an upper wall 21 of the housing 2, and the other part of the conductive sheet structures 1 is fixed to a side wall 22 of the housing 2. Exemplarily, as shown in FIGS. 9 and 10, the high-speed connector may include two conductive sheet structures 1, one of which is located on the upper wall 21 of the housing 2 and the other of which is located on the side wall 22, specifically the front side wall, of the housing 2.

Optionally, at least one of the upper wall 21 or the side wall 22 of the housing 2 is provided with a fixing groove 23 in which the conductive sheet structure 1 is welded or glued to prevent separation of the conductive sheet structure 1 from the housing 2.

In an exemplary embodiment, when the high-speed connector includes one conductive sheet structure 1, the upper wall 21 or the side wall 22 of the housing 2 may be provided with one fixing groove 23 in which the one conductive sheet structure 1 is welded or glued. In an exemplary embodiment, when the high-speed connector includes a plurality of conductive sheet structures 1, a part of the conductive sheet structures 1 is disposed on an upper wall 21 of the housing 2 and the other part of the conductive sheet structures 1 is disposed on a side wall 22 of the housing 2, only the upper wall 21 of the housing 2 may be provided with one or more fixing grooves 23 in which a respective conductive sheet structure disposed on the upper wall 21 of the housing 2 is welded or glued, or only the side wall 22 of the housing 2 may be provided with one or more fixing grooves 23 in which a respective conductive sheet structure disposed on the side wall 22 of the housing 2 is welded or glued, or the upper wall 21 and the side wall 22 of the housing 2 are provided with fixing grooves in each of which a respective one of the plurality of conductive sheet structures is welded or glued.

FIG. 10 is a schematic view showing the side wall 22 of the housing 2 having the fixing groove 23. When a fixing groove 23 is disposed on the upper wall 21 of the housing 2, reference can be made to the structural arrangement in which the side wall 22 has a fixing groove 23.

The preceding embodiments illustrate only the basic principles and features of the present disclosure. The present disclosure is not limited by the preceding embodiments. Various modifications and variations made without departing from the spirit and scope of the present disclosure fall within the scope of the present disclosure. The scope of the present disclosure is defined by the appended claims and their equivalents.

What is claimed is:

1. A conductive sheet structure, comprising:

a conductive sheet, which is strip-shaped; and a plurality of spaced elastic arms disposed on the conductive sheet, wherein each of the plurality of elastic arms extends in a length direction of the conductive sheet and comprises a connecting section, a tilt section and a contact section which are connected in sequence, the connecting section is fixedly connected to the conductive sheet, the tilt section is tilted relative to the conductive sheet and an tilt angle between the tilt section and the conductive sheet is variable, and the contact section is used for contacting with a grounding terminal on a high-speed connector, and wherein every two elastic arms, which are adjacent to each other along the length direction of the conductive sheet, of the plurality of elastic arms extend toward each other to enable contact sections of the two elastic arms to be in contact with a same grounding terminal.

2. The conductive sheet structure of claim 1, wherein a contact surface, which is contacted with the grounding terminal, of the contact section is flat.

3. The conductive sheet structure of claim 1, wherein the conductive sheet is provided with a plurality of openings, and the two elastic arms are fixed in a respective one of the plurality of openings.

4. The conductive sheet structure of claim 3, wherein a contact surface, which is contacted with the grounding terminal, of the contact section is flat.

5. The conductive sheet structure of claim 3, wherein each of the plurality of openings is a rectangle opening, the two elastic arms are respectively fixed to two opposite inner walls of the respective one of the plurality of openings.

6. The conductive sheet structure of claim 5, wherein a contact surface, which is contacted with the grounding terminal, of the contact section is flat.

7. The conductive sheet structure of claim 5, wherein the two elastic arms are staggered, or the two elastic arms are symmetrically arranged.

8. The conductive sheet structure of claim 7, wherein a contact surface, which is contacted with the grounding terminal, of the contact section is flat.

9. The conductive sheet structure of claim 7, wherein the plurality of openings are arranged in an array on the conductive sheet.

10. The conductive sheet structure of claim 9, wherein a contact surface, which is contacted with the grounding terminal, of the contact section is flat.

11. The conductive sheet structure of claim 1, wherein the plurality of elastic arms comprise a plurality of first elastic arms and a plurality of second elastic arms, wherein the plurality of first elastic arms are disposed on an edge of one side of the conductive sheet with spacings, the plurality of second elastic arms are disposed on an edge of the other side of the conductive sheet with spacings, and the two elastic arms comprise one of the plurality of first elastic arms and one of the plurality of second elastic arms, wherein the one of the plurality of first elastic arms and the one of the plurality of second elastic arms are adjacent to each other along the length direction of the conductive sheet and extend toward each other to enable the contact sections of the one of the plurality of first elastic arms and the one of the plurality of second elastic arms to be in contact with the same grounding terminal.

12. The conductive sheet structure of claim 11, wherein a contact surface, which is contacted with the grounding terminal, of the contact section is flat.

13. A high-speed connector, comprising:

a housing;

a plurality of grounding terminals and a plurality of signal terminals, both of which are fixed to the housing; and a conductive sheet structure, wherein the conductive sheet structure comprises:

a conductive sheet, which is strip-shaped; and a plurality of spaced elastic arms disposed on the conductive sheet, wherein each of the plurality of elastic arms extends in a length direction of the conductive sheet and comprises a connecting section, a tilt section and a contact section which are connected in sequence, the connecting section is fixedly connected to the conductive sheet, the tilt section is tilted relative to the conductive sheet and an tilt angle between the tilt section and the conductive sheet is variable, and the contact section is used for contacting with a grounding terminal on the high-speed connector, wherein the conductive sheet structure is fixed to the housing, and each contact section abuts against one grounding terminal of the plurality of grounding terminals, and wherein every two elastic arms, which are adjacent to each other along the length direction of the conductive sheet, of the plurality of elastic arms extend toward each other to enable contact sections of the two elastic arms to be in contact with a same one of the plurality of grounding terminals.

14. The high-speed connector of claim 13, wherein the plurality of elastic arms comprise a plurality of first elastic arms and a plurality of second elastic arms, wherein the plurality of first elastic arms are disposed on an edge of one side of the conductive sheet with spacings, the plurality of second elastic arms are disposed on an edge of the other side of the conductive sheet with spacings, and the two elastic arms comprise one of the plurality of first elastic arms and one of the plurality of second elastic arms, wherein the one of the plurality of first elastic arms and the one of the plurality of second elastic arms are adjacent to each other along the length direction of the conductive sheet and extend toward each other to enable the contact sections of the one of the plurality of first elastic arms and the one of the plurality of second elastic arms to be in contact with the same grounding terminal.

15. The high-speed connector of claim 13, wherein the high-speed connector comprises a plurality of conductive sheet structures, a part of the plurality of conductive sheet structures is fixed to an upper wall of the housing, and the other part of the plurality of conductive sheet structures is fixed to a side wall of the housing.

16. The high-speed connector of claim 15, wherein the upper wall and the side wall of the housing are provided with fixing grooves in each of which a respective one of the plurality of conductive sheet structures is welded or glued.

17. The high-speed connector of claim 13, wherein the conductive sheet is provided with a plurality of openings, and the two elastic arms are fixed in a respective one of the plurality of openings.

18. The high-speed connector of claim 17, wherein each of the plurality of openings is a rectangle opening, the two elastic arms are respectively fixed to two opposite inner walls of the respective one of the plurality of openings.

19. The high-speed connector of claim 18, wherein the two elastic arms are staggered, or the two elastic arms are symmetrically arranged.

20. The high-speed connector of claim 19, wherein the plurality of openings are arranged in an array on the conductive sheet.

* * * * *